US010913518B2

(12) United States Patent
Prade et al.

(10) Patent No.: US 10,913,518 B2
(45) Date of Patent: Feb. 9, 2021

(54) INFLATABLE WATERCRAFT AND METHOD FOR THE PRODUCTION THEREOF

(71) Applicant: Ernstfried Prade, Kinsau (DE)

(72) Inventors: Ernstfried Prade, Kinsau (DE); Daniel Weinberger, Apfeldorf (DE)

( * ) Notice: Subject to any disclaimer, the term of this patent is extended or adjusted under 35 U.S.C. 154(b) by 0 days.

(21) Appl. No.: 16/634,943

(22) PCT Filed: Jul. 30, 2018

(86) PCT No.: PCT/EP2018/070616
§ 371 (c)(1),
(2) Date: Jan. 29, 2020

(87) PCT Pub. No.: WO2019/025375
PCT Pub. Date: Feb. 7, 2019

(65) Prior Publication Data

US 2020/0239113 A1 Jul. 30, 2020

(30) Foreign Application Priority Data

| | | |
|---|---|---|
| Jul. 29, 2017 | (DE) | 10 2017 007 243 |
| Nov. 22, 2017 | (DE) | 10 2017 010 812 |
| Apr. 18, 2018 | (DE) | 10 2018 003 227 |

(51) Int. Cl.

| | |
|---|---|
| ***B63B 32/51*** | (2020.01) |
| ***B63B 32/53*** | (2020.01) |
| ***B63B 73/46*** | (2020.01) |
| ***B63B 7/08*** | (2020.01) |

(52) U.S. Cl.
CPC ..... *B63B 32/51* (2020.02); *B63B 7/08* (2013.01); *B63B 32/53* (2020.02); *B63B 73/46* (2020.01)

(58) Field of Classification Search
CPC ..... B63B 35/00; B63B 35/72; B63B 35/73; B63B 35/79; B63B 35/85; B63B 7/00; B63B 7/08; B63B 1/00; B63B 32/51; B63B 32/53; B63B 35/7913; B63B 73/46; B63B 7/082
USPC ..... 441/65, 66, 74
See application file for complete search history.

(56) References Cited

U.S. PATENT DOCUMENTS

| | | | | |
|---|---|---|---|---|
| 6,241,568 | B1 | 6/2001 | Simms | |
| 8,591,274 | B2 * | 11/2013 | Haller | B63B 32/51 441/66 |
| 2011/0207376 | A1 | 8/2011 | Lindstrom | |
| 2013/0137319 | A1 | 5/2013 | Haller et al. | |

FOREIGN PATENT DOCUMENTS

| | | | |
|---|---|---|---|
| DE | 3143769 | A1 | 5/1983 |
| DE | 202012005185 | U1 | 10/2013 |
| DE | 102014005970 | A1 | 10/2015 |
| DE | 202014008662 | U1 | 10/2016 |
| DE | 102014005970 | B4 | 4/2017 |
| WO | 8403868 | A1 | 10/1984 |

* cited by examiner

*Primary Examiner* — Lars A Olson
(74) *Attorney, Agent, or Firm* — David Guerra

(57) ABSTRACT

The invention relates to an inflatable watercraft which consists of at least two inflatable parts that are joined together by means of holding strips or the like under preload. The invention also relates to a method for producing said inflatable watercraft and a gluing table that can be used in the production of the watercraft.

20 Claims, 8 Drawing Sheets

Fig.1
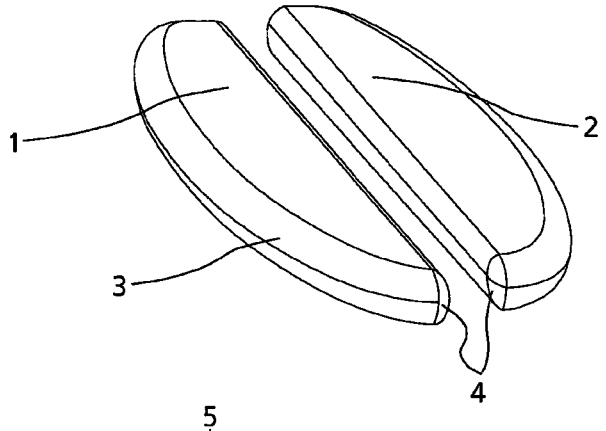
Fig.2
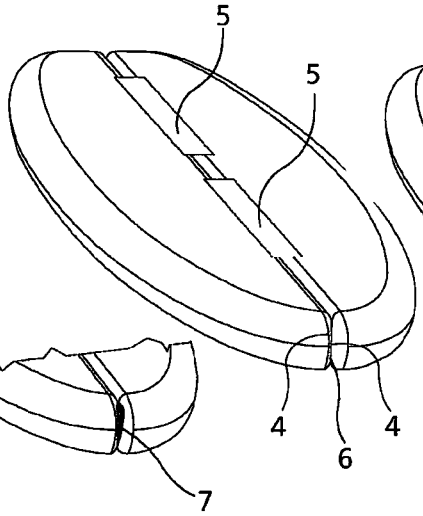
Fig.3
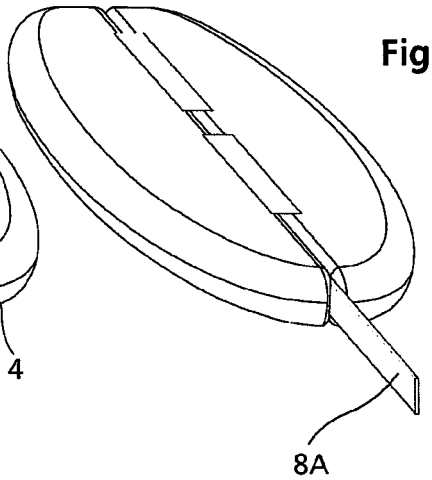
Fig.2A
Fig.4
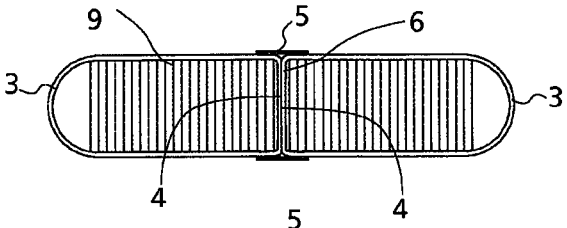
Fig.4A
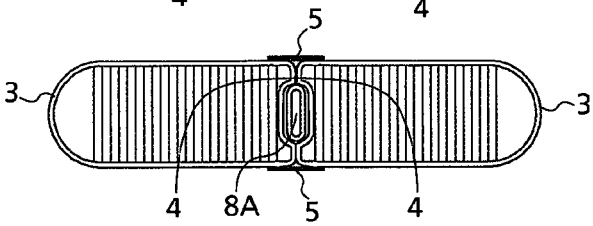
Fig.5
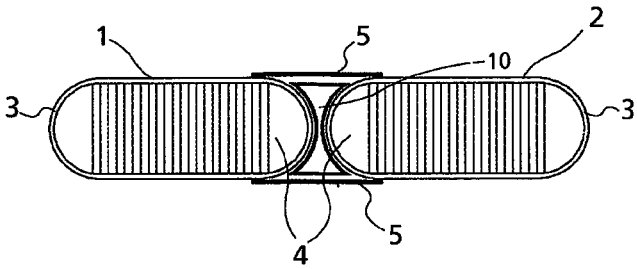

INFLATABLE WATERCRAFT AND METHOD FOR THE PRODUCTION THEREOF

CROSS-REFERENCE TO RELATED APPLICATIONS

This application is an U.S. national phase application under 35 U.S.C. § 371 based upon co-pending International Application No. PCT/EP218/070616 filed on Jul. 30, 2018. Additionally, this U.S. national phase application claims the benefit of priority of co-pending International Application No. PCT/EP218/070616 filed on Jul. 30, 2018, which claims priority to German Application No. 10 2017 007 243.4 filed on Jul. 29, 2017, German Application No. 10 2017 010 812.9 filed on Nov. 22, 2017, and German Application No. 10 2018 003 227.3 filed on Apr. 18, 2018. The entire disclosures of the prior applications are incorporated herein by reference.

BACKGROUND

Technical Field

The invention relates to an inflatable watercraft according to the generic clause of patent claim 1 and to a method for the production of such a watercraft.

Background Description

Known drop stitch surfboards or kayaks have a slack outer shell and can be rolled up when deflated. When inflated, they have only a low rigidity because of the flexible outer skin. The low rigidity presents a major drawback compared to surfboards or kayaks with a rigid outer shell. However, these boards and kayaks made of hard plastics cannot be folded.

The weight of the person practising sport, usually standing or sitting in the middle, deforms the inflatable surfboard or kayak in such a manner that it is subjected to downward sagging in the middle, resulting therefore in the bow and stern being bent upwards. For a favourable stream-lined performance, the surfboard or kayak should however not become deformed.

U.S. Pat. No. 8,591,274 B2 shows two surfboard halves, which are adhesively bonded together in such a manner that a channel is formed in their centre into which a tube or a stiffening member is inserted in order to stiffen the surfboard. The relatively loose connection of the tube to the two surfboard halves attains only slight stiffening of the surfboard. This can be seen particularly clearly in FIG. 1C of this printed document, in which the surfboard is shown in the inflated state and the channel, including its flat walls, can be seen. Any tensioning with the stiffening member to be inserted is neither shown nor described. The chamber-defining side surfaces and the outer side surfaces are also designed flat without an inserted stiffening member—in practice, this cannot be realised.

WO 84/03868 A1 describes a method for manufacturing inflatable structures, in particular surfboards. This surfboard has two or a plurality of inflatable air chambers, which are disposed on a stiffening member, forming, for example, the bottom of the surfboard. Between the two air chambers, a stiffening member is inserted in an open channel and the entire module, including the air chambers, the stiffening member and the bottom, is inserted into a shell.

In all embodiments described in this printed document, the stiffening members—similar to the prior art described above—are inserted into chambers, the walls of which extend in spaced apart relationship in relation to the stiffening member, such that it is slidably received. In this context, the air chambers are created in an additional rigid shell, formed, on the one hand, by the bottom stiffening member and, on the other hand, by the rigid covering. Such a structure is designed in a very complex manner and requires considerable effort and expense from a manufacturing point of view, the production of surfboard-like structures not being possible or possible only with great effort and at great expense. For example, a base which is rigid in one direction cannot be introduced into a surfboard whose enveloping form is constantly changing, both in thickness and in width. This would require the described all-embracing covering to open at least along the longitudinal axis of the board, but such is neither shown nor described.

Based on applicant's DE 20 2014 008 662 U1, an inflatable surfboard is described, to the shell of which stiffening bottom elements are fitted. The attachment of these bottom elements is done, for example, by way of form-fitting connections, which are inserted into recesses of the surfboard.

DE 20 2012 005 185 U1, likewise derived from the applicant, discloses an inflatable floating body which is made of drop stitch material and into which reinforcements are inserted for improving form stability.

A collapsible surfboard with a supporting beam extending in the longitudinal direction and two air bodies is described in DE 31 43 769 A1.

The document US 2011/0207376 A1 is concerned with the structure of a collapsible watercraft, in which tensioning is brought about by traction elements.

All of these solutions have, on the one hand, a very complex structure and ensure no significant improvement of stiffness in watercraft produced according to the drop stitch process.

BRIEF SUMMARY OF THE PRESENT TECHNOLOGY

It is the object of the present invention to provide an inflatable watercraft, in particular, a surfboard or kayak, made of drop stitch material, which is easy to manufacture and has maximum longitudinal stiffness. It is a further object of the invention, to provide a method for producing such a watercraft.

The invention also includes an adhesive bonding table, which is described in detail in the following elucidation of the invention. The applicant reserves the right to formulate an independent patent application for this adhesive bonding table.

Advantageous further developments form the subject of the subsidiary claims.

The inflatable watercraft according to the invention is made of drop stitch material, at least in sections, and has at least two parts, preferably two halves, each of which forms a sealed air chamber. These parts are joined together on the deck side and the underwater hull side by retaining strips in such a manner that the two parts/halves, in the inflated state of the adjacent parts, are braced with each other or that a cavity is formed into which a stiffening member can be inserted, the structure of the retaining strips or retaining sleeves being so designed that the adjacent parts of the watercraft are tensioned with the intermediate stiffening members and/or other internal components, in which case, according to a further development, the drop stitch threads adjacent to the contact region of the parts come to rest relatively closely to each other, so that the stiffness in this region is optimised.

In a preferred embodiment of the invention, the retaining strips or retaining sleeves are designed such that the two parts of the watercraft undergo such high contact pressure during inflation that the inner, mutually adjacent sidewalls form an approximately straight (flat) surface at the upper level of the watercraft. That is to say, the usual bulge for a drop stitch design is equalised by the contact pressure, so that a planar abutment is brought about in this region.

In this context, in a preferred further development of the invention, the drop stitch threads are arranged in the region of these inner sidewalls, such that this region offers maximum stability.

The sidewall lips positioned on the outer circumference of the watercraft are then further bulged/rounded in a manner known per se.

The longitudinal stiffness is thus attained in that the maximum internal pressure of, for example, 10 to 20 PSI applies contact pressure to the lateral surfaces of the stringer or to the sidewalls of the parts/halves. In this case, at the top and at the bottom, the two halves or the neighbouring parts are so tightly clamped, preferably by retaining strips or retaining sleeves adhesively bonded thereto, that the inner sidewall lips of the two halves/parts, after inflation, form an approximately straight surface at the upper level of the watercraft.

In order to attain the high contact pressure according to the invention, the above-mentioned adhesive bonding table according to the invention is used, by means of which the two halves, in the inflated state, are so tightly pressed against each other that the inner sidewall lips of the halves adjoining one another at the level of the watercraft form an approximately straight surface, the inner drop stitch rows, in this case, being placed directly side-by-side. Only after this pressing and aligning of the halves/parts are the retaining strips glued on or applied in any other way. This type of adhesive bonding attains the required contact pressure on the inner sidewalls, the stiffening members and the inserts. To this end, bars which are displaceable on both sides, are provided on the enveloping form of the watercraft, engaging in grooves and adapted to be displaced from the outer edge of the watercraft, in the direction of the centreline of the watercraft. Upper horizontal support bars, set to the height of the watercraft, thereby force the inflated halves into a horizontal position.

A major problem in the production of inflatable surfboards from drop stitch material is the twist which comes about in the hand-crafted surfboards. In this case, the upper and lower surfboard covering twists about the longitudinal axis of the board. The underwater hull is then no longer flat, but, depending on the distortion, one outer edge of the surfboard points up or down. The adhesive bonding table according to the invention has made it possible for the first time to produce, for example, surfboards consisting of two halves in an entirely flat manner, without causing any twist.

One or a plurality of stiffening members may be introduced into the watercraft.

Preferably, internal components of the watercraft, such as fin cases, a foot strap support and a mast base strap or stiffening panels of a surfboard are connected to the stiffening members on the upper or underside of the board, thus forming a rigid structural unit.

The insertion and removal of the stiffening members may be performed from the front or rear, but also by bending the slack, non-inflated watercraft covering via the apertures for the internal components such as the fin case or mast base strap.

In a drop stitch material thousands of polyester threads of equal length keep top and bottom together parallel. This special drop stitch material, due to its design, is manufactured in panels, which are open on both sides and which must be provided with a sidewall, so as to obtain a closed body which can be filled with air.

Since this side wall does not include a strut, as with drop stitch material, wherein the polyester threads keep top and bottom parallel, the sidewall bulges outwardly, forming a round sidewall. This is, however, undesirable on the inner halves, for which reason, in the embodiment according to the invention, the two halves are so joined together that the inner drop stitch rows come to lie side-by-side. Only then are the two halves adhesively bonded together with retaining strips in the mid-ship plane at the upper side and underside of the surfboard, so that a cavity is formed between the surfboard halves, in which, prior to inflation of the surfboard, one or a plurality of stiffening members may be inserted. After inflation of the two surfboard halves, which are firmly joined to form a board by way of the retaining strips on the upper side and underside, the inner wall of the left and right surfboard halves presses against the stiffening members inserted between the surfboard halves under high pressure, fixing the latter in the mid-ship axis. In order to better fix flat stringers, the cavity between the inner sidewall lips can be reduced. To this end, the sidewall lips are additionally adhesively bonded at the top and at the bottom.

In a further embodiment according to the invention, the two halves are releasably interconnected at the top and/or at the bottom over partial sections or over the entire length by means of split retaining strips, such as by a zipper or hook or eyelets. If in the slack deflated state the upper zipper is opened, stringer and internal components can be easily introduced between the two halves and anchored, if so required.

Preferably, thin stiff fabric foils are used, which can be rolled up for transport, laid side-by-side as a stable stringer. Stiff foils, adapted to be rolled up, may, however, also be bonded directly to the inner sidewall lips of the left and right halves.

In specific zones, the thin foils may be superimposed twice or more times, in order to produce more stiffness in these zones.

However, thin stringers of hard material may also overlap in specific zones in order to create more stiffness there.

The stringers, which are separable for transport purposes, need not be screwed to form a long stringer prior to use. It suffices if they have protuberances and depressions which interlock. Between the two halves they are firmly joined together under the high contact pressure of the inner sidewall lips.

In a further embodiment according to the invention, there is located in the centre, between the two halves, a stringer made preferably of metal or a high-strength plastics material comprising grooves on both sides and a third groove on its upper side. Retaining strips with a tongue formation, adhesively bonded to the halves, are inserted into the lateral grooves. This type of fixing not only joins together the two halves, but at the same time keeps the stringer stationary. On the upper side of this stringer, functional elements such as a mast base, foot straps or other elements can be connected to the upper side in a third groove.

After the halves have been deflated, the stiffening members may be removed again from the cavity between the inner sidewall lips, so that the slack covering can easily be rolled up.

In a further embodiment according to the invention, stiffening members with concave parts are inserted into an elongate recess of the watercraft, in particular a surfboard, which, after inflation of the watercraft, anchor themselves automatically to the convex sidewall lips of the cut-out in form-fitting manner.

In a further embodiment according to the invention, the effective width and, accordingly, the tensioning of the retaining strip applied between the two halves between the upper side and the underside varies in width. If the retaining strips at the top and at the bottom are of even width (same tensioning), the left surfboard half form a plane with the right one. If the bottom retaining strip is shortened (higher tensioning at the bottom), the gliding surface becomes convex. Especially with surfboards which are used for competitions, convex and concave zones alternate in the underwater craft.

According to the embodiment in accordance with the invention, the two surfboard halves may form a convex underwater hull in the bow region in order to merge into a straight line after the first third of the underwater hull, thereafter generating a concave zone in order to be again configured straight or convex towards the tail end of the surfboard.

In a further embodiment according to the invention, a flat stringer in the mid-ship plane projects beyond the watercraft, for example, the surfboard or the kayak, at the front or at the front and at the back.

The contact pressure of the two side parts on the stiffening member is so high that it can be used as bow and stern without any further supports.

From the projecting end of the stringer, for example, a watertight and airtight covering stretches towards the board or the boat body. This covering may also be inflated. The thin end of the stiffening member in the form of a stringer, which is enclosed by the watertight covering, preferably forms a pointed bow or a pointed stern of the watercraft, in particular of the surfboard or kayak.

As stated, the watercraft is preferably designed as a board (SUP, windsurf board, kitesurf board, foil board, surfboard) or as a canoe or a kayak.

An adhesive bonding table for performing the method is designed, for example, with an adjustable tensioning device for tensioning the parts, configured in such a manner that the inflated parts can be inserted and thereafter braced by adjustment, so that the sidewalls are braced directly or with stiffening members, inserted therebetween.

In a further development of the adhesive bonding table, the latter is configured with lateral, approximately vertically arranged bars, which bear against the outer sides of the halves of the watercraft, pressing these together under high pressure. The bars are in this case arranged in an adjustable manner, so that various watercraft shapes may be processed on the adhesive bonding table.

In a further development of the adhesive bonding table, the latter is designed with two sliding-apart or foldable adhesive bonding table sides.

The vertically disposed bars may themselves comprise upper horizontal support bars, which rest on the parts on the deck side. In addition, horizontal bars may be provided on the bars located at the bottom, on which the parts will then rest. The bars, in turn, are disposed to be adjustable, so that twisting of the parts, prior to adhesive bonding, may be corrected and the former may be reliably held in the desired relative position.

Such rod formations are arranged along the entire outline of the watercraft.

BRIEF DESCRIPTION OF THE DRAWINGS

Further details of the invention are apparent from the following description of a plurality of embodiments with reference to the accompanying drawings. There is shown in:

FIG. 1, a schematic diagram of a divisible inflatable surfboard;

FIG. 2, the two surfboard halves shown in FIG. 1, which are joined to retaining strips;

FIG. 2A, the arrangement according to FIG. 2 in the non-inflated state;

FIG. 3, the arrangement according to FIG. 2 with an inserted stiffening member;

FIGS. 4, 4A, 5, cross-sections of embodiments of an inflatable surfboard;

DETAILED DESCRIPTION OF THE PRESENT TECHNOLOGY

Figure 5A:
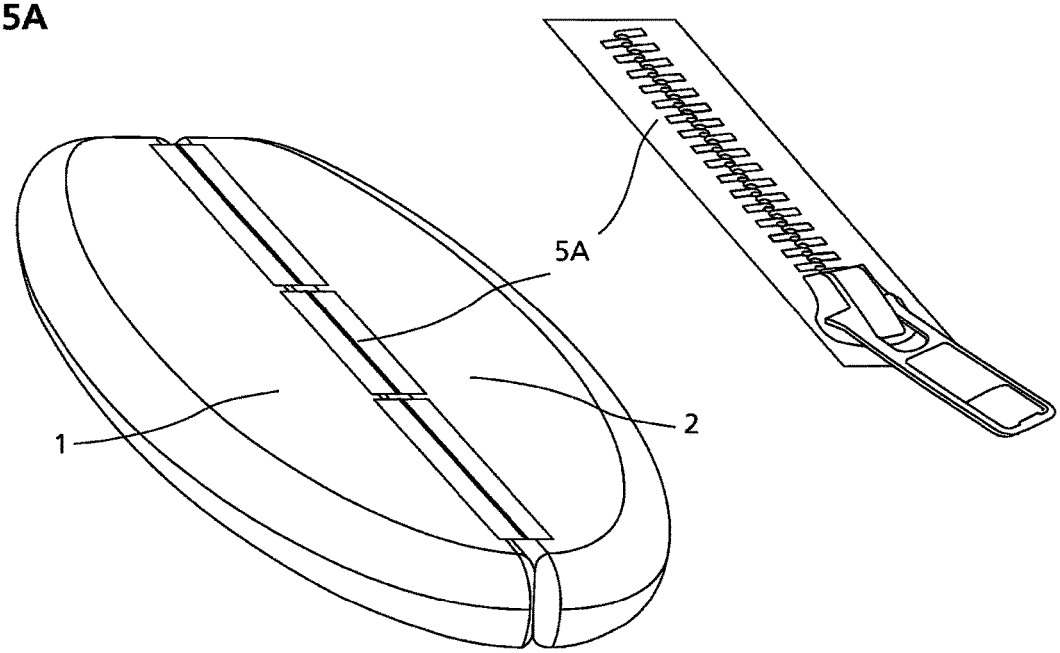
FIG. 5*a* a modification of the embodiment according to FIG. 2 with releasable retaining strips.

The basic concept of the invention is clearly shown in FIGS. 1 to 3, in which, by way of example, the watercraft is designed as a board (SUP), windsurf board, kite surfboard, foil board, surfboard or the like.

Prior to a detailed description of the Figures, the essential content of the Figures is summarised as follows.

FIG. 1 shows a left inflated surfboard half 1 and a right inflated surfboard half 2. In both halves an outer sidewall lip 3 is bulged outwardly and an inner sidewall lip 4 is bulged inwardly.

According to FIG. 2, the two halves are joined together by adhesively bonded retaining strips 5 on the upper side and underside of the surfboard, such that the rounded inner sidewall lips 4 are flattened under the high air pressure prevailing in the surfboard halves and are lying side-by-side 6.

FIG. 2A shows a cavity 7 between the two inner sidewall lips of the surfboard, which arises if the latter is not inflated.

FIG. 3 shows a stiffening member 8, for example, in the form of a stringer 8A, which is inserted into the cavity 7 between the two surfboard halves.

FIG. 4 shows a section through the inflated surfboard with drop stitch threads 9, which are stretched between the top and the bottom, keeping them parallel in relation to one another. The retaining strips 5 are so adhesively bonded to the upper side and underside of the surfboard that the surfboard halves are forced against one another in such a manner that the inner sides are pressed against each other, forming a straight surface at the top level of the surfboard.

FIG. 4A shows a section through an inflated surfboard, in which a narrow stringer 8A in the form of a flat tube is introduced, which stringer is enclosed by the inner sidewalls of the two surfboard halves.

FIG. 5 shows a section through an inflated surfboard, the two halves of which are adhesively bonded to one another by wide retaining strips 5 on the upper side and underside of the surfboard in such a manner that a space remains between the two surfboard halves and the two inner sidewall lips 4 do not touch, so that a stiffening member 10 with cavity lips can be accommodated.

FIG. 5A shows the upper side of a surfboard, in which the left half 1 and the right half 2 are joined with zippers 5A which are divided into segments.

Figure 5B:
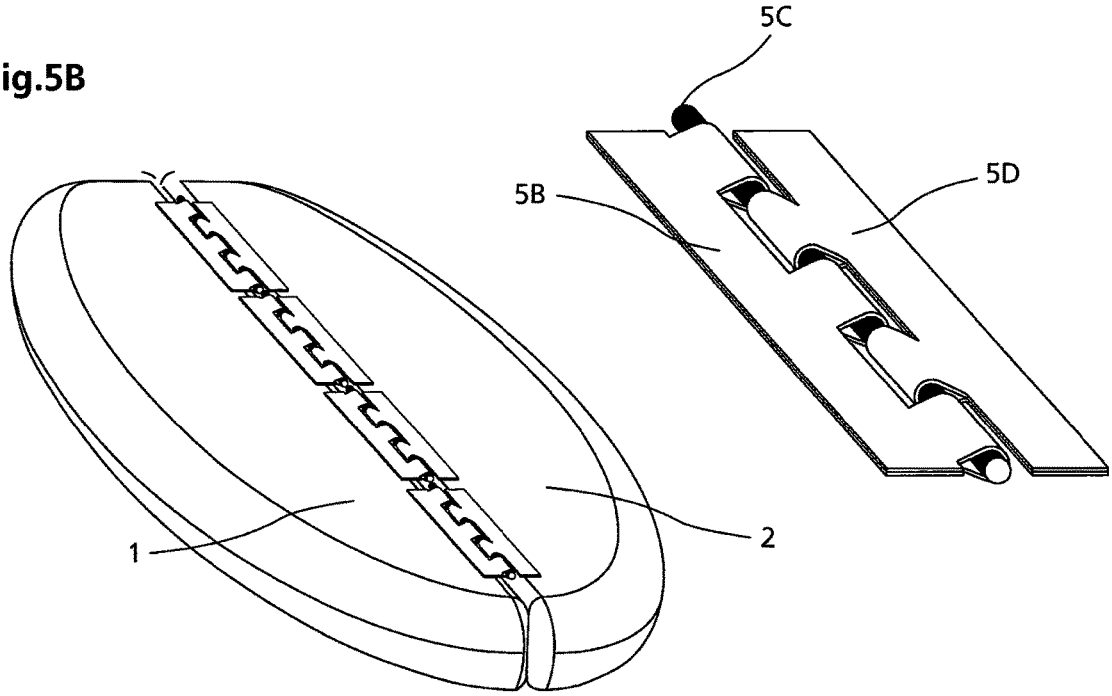
FIG. 5B, an embodiment with a tongue formation connection.

FIG. 5B shows the upper side of a surfboard, in which the left surfboard half 1 is adhesively bonded by a row of sleeves 5B made of plastic material and in which the right surfboard half 2 is adhesively bonded by a row of sleeves 5D made of plastic material. Both rows of sleeves are connected by a metal or plastic rod 5C.

Figure 5C:
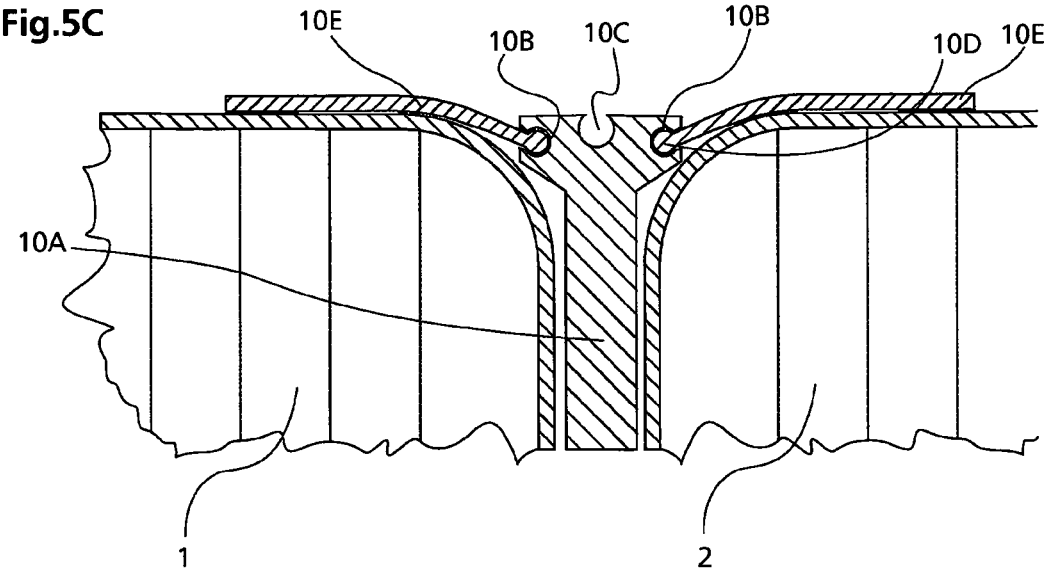
FIG. 5C, a section through a surfboard, wherein the surfboard halves are tensioned by means of a tongue formation connection.

FIG. 5C shows a section through a surfboard with the left surfboard half 1 being inflated and the right surfboard half 2 being inflated. In the centre between the surfboard halves a metal stringer 10A is located with a groove 10B on both sides and a further groove 10C on the upper side of the stringer. Into the grooves 10B on the left and on the right on the metal stringer 10A tongue formation retaining strips 10E which are adhesively bonded to the surfboard half, engage with a tongue formation 10D.

Figure 5D:
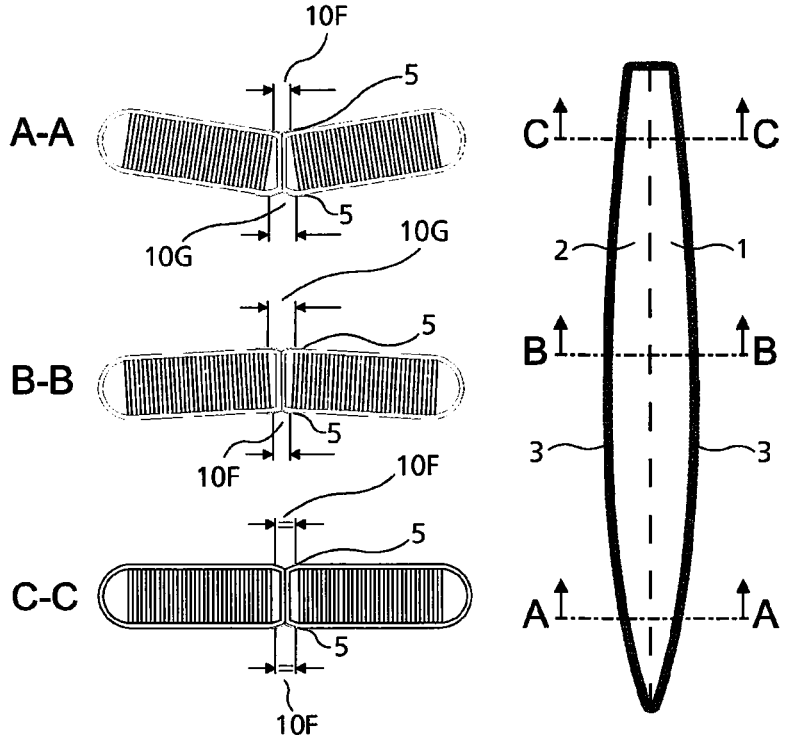
FIG. 5D, views of a competition surfboard with an optimised underwater hull.

FIG. 5D shows views of a typical surfboard which is used in competitions. Section A-A shows the surfboard in the bow region with a convex underwater hull having wider adhesive bonding 10G and narrower adhesive bonding 10F (the importance of "narrower" and "wider" will be discussed in what follows). Section B-B shows the central region of the surfboard with a concave underwater hull having a lower, narrower adhesive bonding 10F and a wider adhesive bonding 10G. Section C-C shows the tail region of a surfboard having a flat underwater hull, in which both retaining strips are equally wide at the bottom and at the top. The transitions between the concave, convex or straight underwater hull are seamless.

Figure 5E:
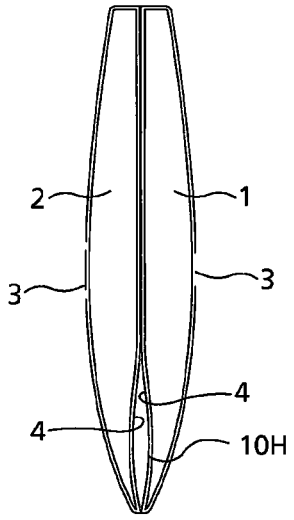
FIG. 5E, surfboard halves of a further embodiment, wherein the former are hollowed out in the bow region.

FIG. 5E shows a surfboard, consisting of two halves, the latter being hollowed out on their upper side and in the bow region 10H.

Figure 6:
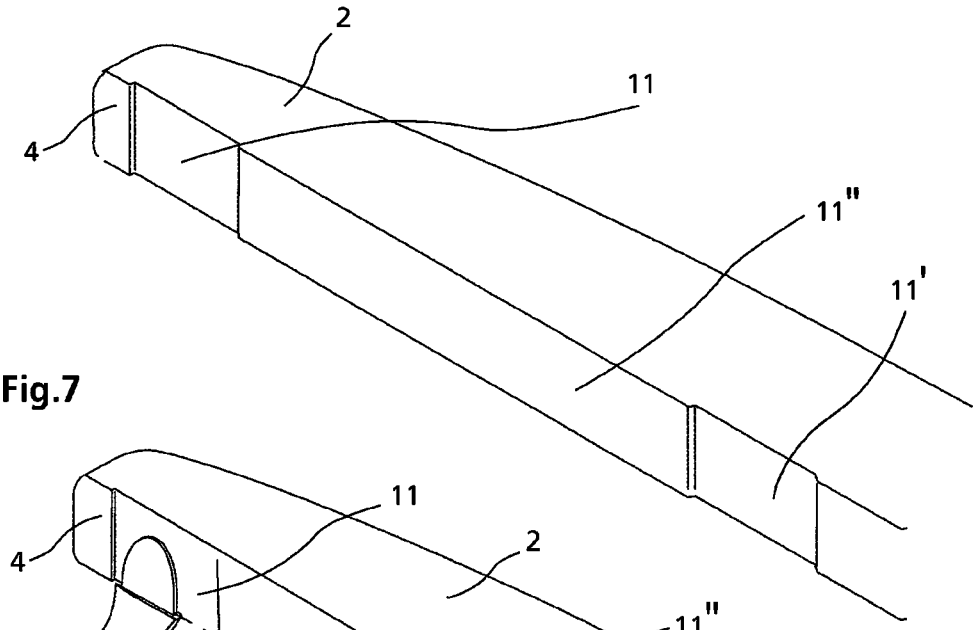
FIGS. 6, 7, 8, embodiments, in which functional elements such as a centreboard or a fin, a centreboard case or the like are kept in the board body.

FIG. 6 shows a right surfboard half 2 with recesses 11 for internal components such as a fin case 12, a watertight case 13 for storing objects such as a mobile phone or car keys, and a mast base receiving means 15.

Figure 7:
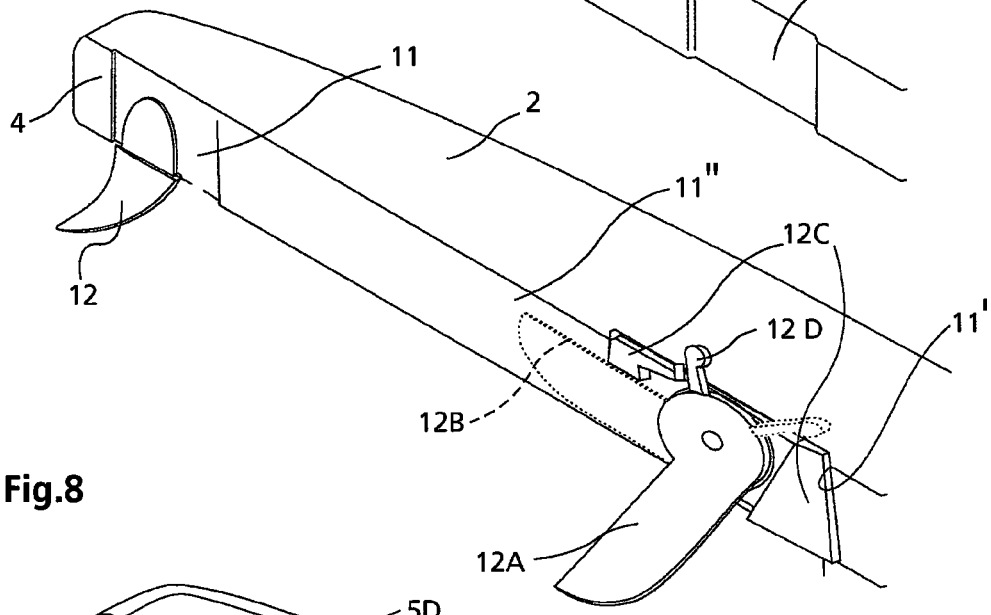

FIG. 7 shows a perspective view of a right surfboard half 2, in which, in a small recess 11, an internal component in the form of a fin 12 is inserted directly between the two surfboard halves 1, 2 without a fin case. Furthermore, a mobile centreboard 12A, which can be folded away by means of an operating lever 12D (position 2B), is inserted by way of a centreboard case 12C directly between the two surfboard halves. For this purpose, appropriate recesses are located in the upper and lower retaining strips, through which the foldable centreboard projects downwardly from the board while the operating lever 12D, by which the foldable centreboard can be actuated, projects beyond the top.

Figure 8:
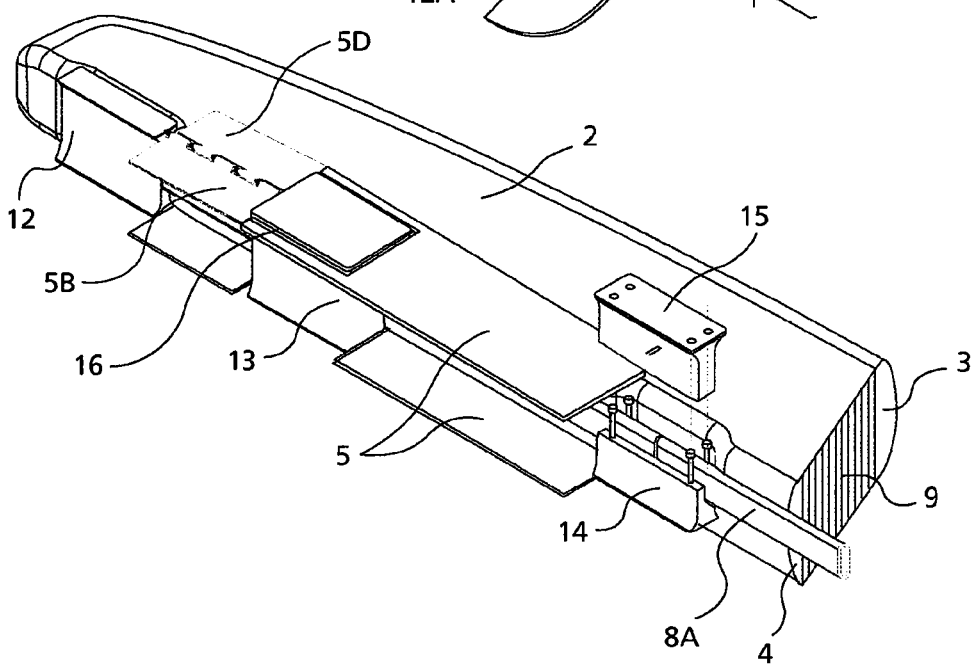

FIG. 8 shows a perspective view of a right surfboard half 2 with drop stitch threads 9 and sidewall lips 3, 4 and retaining strips 5 adhesively bonded to the upper side and underside of the surfboard or by means of a sleeve/strap connection 5B, 5D, which is adhesively bonded between the internal components 12, 13, 14, 15 or is provided with a cut-out 16, through which the internal component projects in such a manner that on this internal component, at the upper side and/or the underside of the surfboard, other parts, such as a foot strap attachment or panels, representing a gliding surface, may be fitted.

Figure 8A:
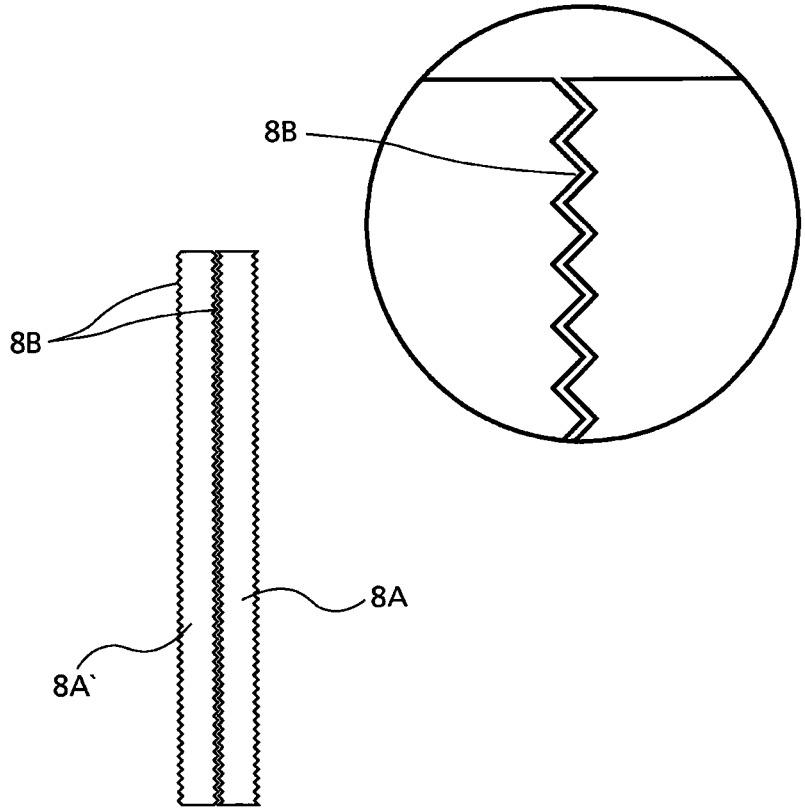
FIG. 8A, an individual representation of a stiffening member designed as a stringer.

FIG. 8A shows the stringer 8A in cross-section, the outside of which is structured in the form of lines or projections 8B, such that a plurality of stringers 8A may be positioned side-by-side in sandwich-like fashion.

Figure 8B:
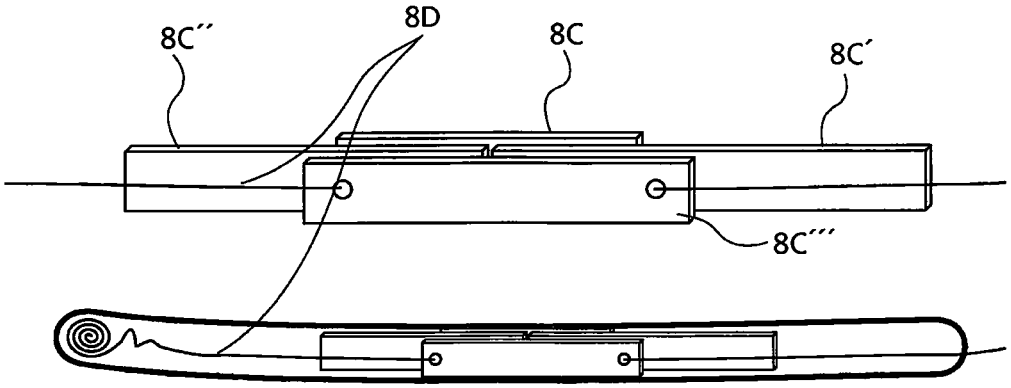
FIG. 8B, a modification, in which ropes are used for positioning a stiffening member.

FIG. 8B shows thin stringers 8C which, positioned side-by-side, enhance the rigidity of certain regions. Here, ropes 8D are used in order to maintain the individual stringers of different lengths at designated positions. The ropes remain on the surfboard so that the stringers, upon renewed inflation of the surfboard halves 1, 2, can again be retracted therewith.

Figure 9:
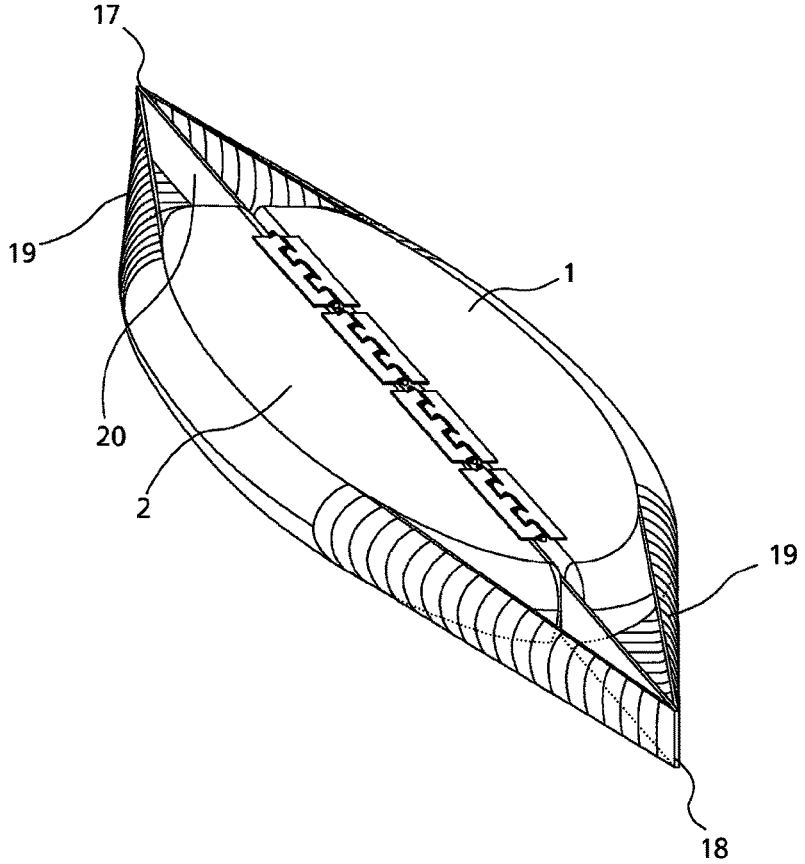
FIG. 9, a three-dimensional representation of a further embodiment of a watercraft, in particular a surfboard, with a configuration according to the invention of a bow or a stern, respectively.

FIG. 9 shows a surfboard obliquely from above with a stiffening member in the form of a flat stringer 20, projecting beyond the surfboard, the ends of the said stringer forming a pointed bow 17 and a pointed stern 18 and a watertight and airtight covering 19, open at the top, which extends from the pointed ends of the flat stringer 20 to the surfboard and is adhesively bonded thereto all around.

Figure 10:
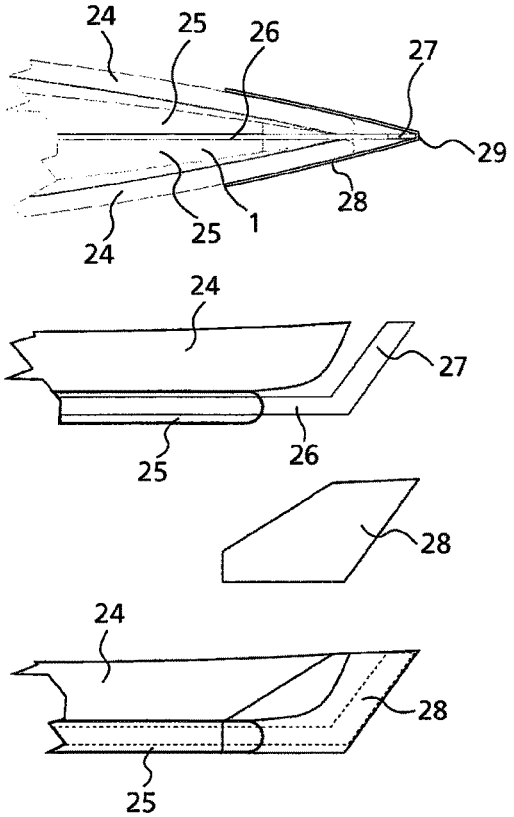
FIG. 10, embodiments for the configuration according to the invention of a kayak bow.

FIG. 10 shows the front part of a kayak in plan view and in a side elevation with sidewalls 24, with a left and a right floor part 25, an upwardly bent stringer 26 forming the upper bow point 29, projects beyond the kayak sidewalls and, at the front, takes on the function of a stem post (Steven) 27. There is further shown a watertight bow covering 28 which stretches from the stem post (Steven) to the sidewalls and is adhesively bonded there.

Figure 11:
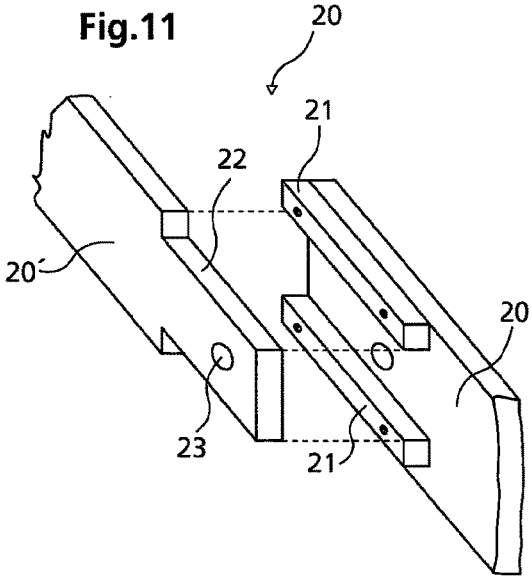
FIG. 11, a modification of a divisible stiffening member.

FIG. 11 shows a stiffening member in the form of a flat stringer 20, onto the one end of which two support strips 21 are bolted. The other end of the flat stringer 20 has rebates 22. A magnet 23 or another connecting means holds together both stringer halves.

Figure 12:
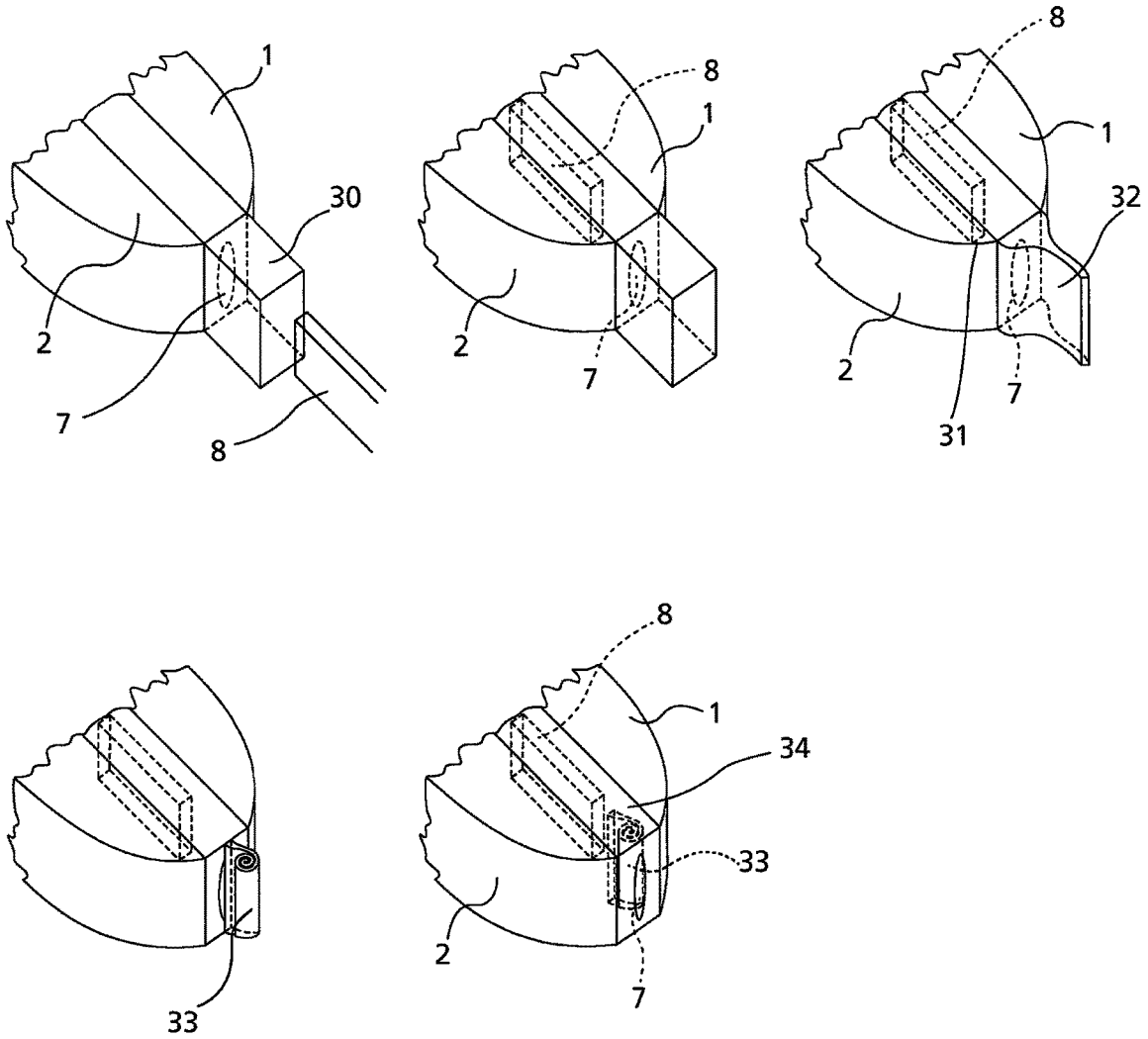
FIG. 12, an embodiment of a watercraft, in which a cavity for receiving a stiffening member is sealed and FIGS. 13, 13A, 13B and 13C, representations of an adhesive bonding table, which is used in the method according to the invention for the production of a watercraft according to the invention.

FIG. 12 shows the watertight sealing of the cavity 7. A flexible, watertight protuberance 30, open at the rear, is adhesively bonded to the surfboard with its cavity 7. Through it, the stiffening member 8 is inserted into the cavity 7 until it is positioned in the surfboard (position 31). The protuberance 30 may be folded up vertically (position 32), rolled up (position 33) and pushed into the cavity 7 (position 34). After inflating the sidewall lips, the rolled up covering is sealed watertight under the contact pressure of the sidewall lips.

Figure 13:
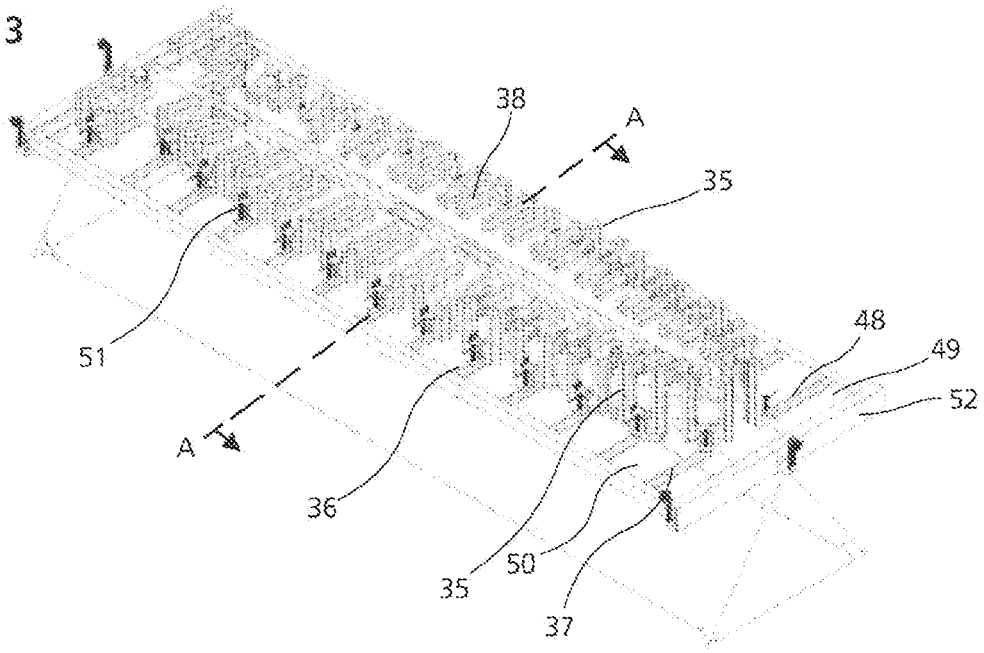

FIG. 13 shows the perspective view of an adhesive bonding table for surfboards, consisting of two halves. To the encasing form of the surfboard, vertical bars 35 are fitted, which are movable on both sides and which are guided in grooves 37 via horizontal bars 36. Upper horizontal support bars 38 are connected to the vertical bars 35.

Figure 13A:
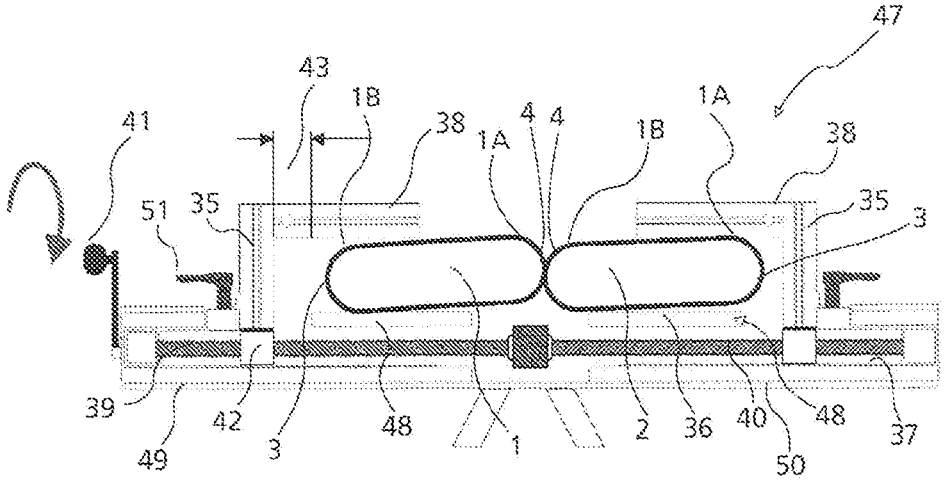

FIG. 13A shows a schematic representation of the adhesive bonding table in section A-A. A drive crank 41 is fitted to a left-turning threaded rod 39 and a right-turning threaded rod 40, which are firmly joined together. A vertical bar 35 is connected to the threaded sleeve 42. An upper horizontal bar 38 is connected to the vertical bar 35. There is furthermore shown a left, twisted surfboard half 1, in which the right side wall (1A) is higher than the left sidewall (1B). A right, twisted surfboard half 2, in which, for example, the right sidewall 1A is higher than the left sidewall 1B. The adhesive bonding table is in the open state, with the vertical bars 35 being spaced apart 43 from the sidewall lips 3, 4 of the surfboard halves 1, 2.

Figure 13B:
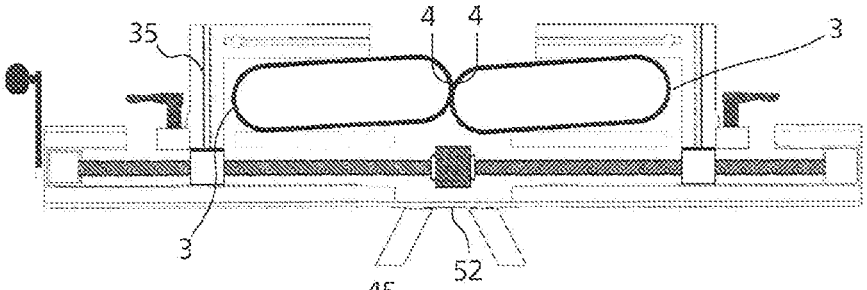

FIG. 13B shows the half-closed adhesive bonding table 47, on which the vertical bars 35 touch the outer sidewall lips 3 and pressure is applied to the inner sidewall lips 4 of the two surfboard halves 1, 2.

Figure 13C:
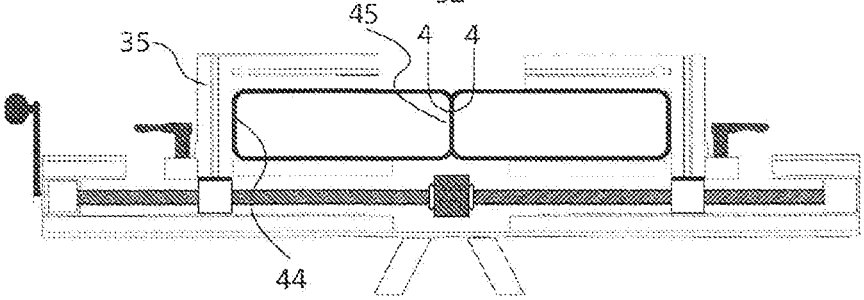

FIG. 13C shows the closed adhesive bonding table 47, on which the vertical bars 35 are pressed against the outer sidewalls 44 and the inner sidewalls 45 are pressed flat against one another. The twisted surfboard halves are then in a straight, plane state.

The above-stated Figures are elucidated in more detail in what follows.

FIG. 1 shows a simplified three-dimensional representation of the two board halves 1, 2 forming the surfboard body in the non-clamped state. One can see that in this "unprocessed state", both the outer sidewall lips 3 as well as the inner sidewall lips 4, facing one another, are bulged convexly. This is a typical profiling for all drop stitch floating bodies, which stems from the fact that in the connecting region between a deck and a bottom ("underwater hull") drop stitch threads are formed and the lateral sealing—as explained in the preamble to the description—is brought about by adhesively bonded sidewall lips. These sidewall lips—as elucidated below by way of FIGS. 4, 4A and 5—are not stabilised by drop stitch threads and therefore bulge out upon inflation under the considerable pressure in a range exceeding 1 bar.

FIG. 2 shows the two inflated surfboard halves 1, 2 of FIG. 1, in which the outer sidewall lips 3 are bent outwardly in bead-like fashion.

Retaining strips 5, which join together the board halves 1, 2 after inflation are adhesively bonded to the upper side (deck) and the underside (gliding surface, underwater hull) of the surfboard. In this case, the two board halves 1, 2 are so tightly clamped together that the drop stitch threads in the board halves 1, 2 almost touch each other or are inserted in narrowly spaced-apart relationship.

According to FIG. 2A, a narrow slot 7 remains between the left and the right surfboard halves 1, 2 in the non-inflated state, into which a stiffening member may be inserted. The retaining strips 5 may be disposed continuously to the surface or may be divided into sections.

Prior to inflation, a stiffening member 8 may be inserted into the slot 7 shown in FIG. 2A—as set out above. In principle, it is however also possible to omit such a stiffening member, since the above-described planar abutment of the inner sidewalls of the surfboard halves 1, 2—hereinafter referred to as board halves—significantly improves the longitudinal rigidity. When inserting a stiffening member into the slot 7, the inner sidewall lips 4 are pressed to the large surface of this stiffening member, so that, likewise, a plane abutment area, at least in sections, is created again between the sidewall lips 3 and the correspondingly designed sidewalls of the resilient element.

Such an embodiment is shown by way of example in FIG. 3, wherein a stringer 8A is used as the stiffening member.

FIG. 3 shows the stringer 8A, which was inserted into the cavity 7 in the non-inflated state and which, in the inflated state, forms a unit with the left and right board halves 1, 2 under the contact pressure, so that the stringer 8A can be displaced neither towards the front nor the rear, nor upwards or downwards.

The high contact pressure of the left and right board halves 1, 2 provides, furthermore, that the stringer 8A undergoes maximum rigidity.

The contact pressure acting on the inner sidewalls and/or the stiffening member (stringer 8A) is substantially determined by preloading the retaining strips 5. If a lower contact pressure prevails, which is brought about by applying reduced preloading to the retaining strips 5, the stringer 8A would lose some of its stiffness, because, due to its relatively loose fit between the two non-flat, but now bulged inner sidewall lips 4, it is not sufficiently stabilised under load and would thus take on a wave-like shape between the two surfboard halves 1, 2.

It is therefore advantageous that the retaining strips 5 are adhesively bonded so tightly to one another, or otherwise secured, that the inner sidewall lips 4 of the surfboard, as shown in FIG. 4, are lying flat side-by-side in the inflated state 6. In this case, according to FIG. 4, in the inflated state, the outer row of drop stitch threads 9 comes to rest on the right side of the left board half 1, next to the outer row of drop stitch threads 9*a* on the left side of the right board half 2. This brings about a homogenous, joined-together drop stitch body, in which the drop stitch threads are positioned across the entire width of the body at approximately the same distance from one another. They occupy the height of the surfboard. This is a significant contrast to the above-mentioned solutions or to the structure in the region of the outer sidewall lips 3, which are not stabilised by drop stitch threads in the region of the rounding and bulge accordingly, in the inflated state, under a predetermined pressure (10 to 15 PSI) to the outside and are thus not stabilised in the bulging region.

FIG. 4A shows a further embodiment, in which a narrow stringer 8A is introduced in-between the sidewall lips 3 lying flat side-by-side, which narrow stringer 8A may also be designed in the form of a flat tube, so that the flat sidewalls above the stringer and below the stringer close completely and the inner sidewall lips 4 of the two board halves 1, 2 entirely enclose the narrow stringer 8A. In order to further increase the rigidity of the enclosed stringer 8A, the two inner sidewall lips 4 of the board halves 1, 2 may be adhesively bonded above and below the stringer 8A.

In principle, it is also possible to form the inner sidewall lips 4 with a profiling, for example, in the form of a groove or receiving means, into which the stringer 8A is then inserted, the latter then being pressed into this groove/receiving means upon inflation. The two grooves/receiving means formed in each side wall lip 4 then combine to form a type of pocket for the stringer 8A.

FIG. 5 shows a further embodiment, in which the stiffening member 10 is configured with cavity lips on the left and on the right, into which, after inflation, the left and right surfboard halves 1, 2 are pressed. This stiffening member 10, designed approximately in the shape of an hourglass, including its concave cavity lips, is adapted to the bulged structure of the inner sidewall lips 4. That is to say, in this embodiment, the bulge of the inner sidewall lips 4 remains similarly configured as in the outer sidewall lips 3—stabilisation is then however brought about by the stiffening member 10 encompassing the sidewalls in sections. In this embodiment, preloading of the retaining strips 5 may possibly be selected to be somewhat less in comparison with the previously described embodiments.

For particularly long surfboards, such as are used, for example, in racing, it is advantageous, as shown in FIG. 5A, to at least provide the upper side of the surfboard with a separable retaining strip, which is, for example, in the form of a zipper 5A. This allows a complete opening of the surfboard such that between the two surfboard halves 1, 2 different stringer types or stiffening members may be inserted very easily.

FIG. 5B shows a further divisible solution, in which a sleeve connection with a row of sleeves 5B is provided on the left surfboard half 1 and a row of sleeves 5D on the right surfboard half 2, in which case the rows of sleeves 5B, 5D inter-engage in a stepped manner, approximately in zigzag fashion. Combining these two rows of sleeves 5B, 5D is brought about by a metal or plastic rod 5C. The inlet and outlet apertures of the rows of sleeves 5B, 5D are in this context aligned coaxially in relation to one another, a sleeve projection engaging in each case in a sleeve recess so that the metal or plastic rod 5C can be introduced in a simple manner.

In order to keep the stiffening member as stationary in the surfboard as possible and to bring about maximum rigidity, according to FIG. 5C a metal stringer 10A may be used as a stiffening member, which has a widening at the top and at the bottom (view according to FIG. 5C), into which two grooves are introduced. This stringer 10A is configured in the manner of a double-T-carrier, in which tensile, bending and compressive strength is considerably increased at the upper side and underside by widening of the stringer 10A. Into each of the two grooves 10B corresponding tongue formation retaining strips 10E are introduced, at the end of which, in each case, a tongue formation 10D is created.

A third groove 10C on the upper side and/or on the underside serves to accommodate other add-on parts, such as fins, mast bases, retaining panels or foot straps, also making it possible to fit gliding surfaces made of hard material to the underside of the surfboard.

In a further embodiment, the stringer 10, 10A may also be configured as an internal component in the form of a centreboard or a fin.

In FIG. 5D an inflatable surfboard, made of two board halves 1, 2 is shown, with the special option of influencing the shape of the underwater hull, which, to date, was reserved only for surfboards with a hard outer shell. This concerns the convex or concave shape of the underwater hull. With regard to the underwater hull, a convex shape normally works better for a surfboard than a concave shape. In order to allow for better buoyancy of the board, a concave shape is disposed in the central region, which then terminates towards the tail end either in a flat or a convex manner.

These different configurations of the underwater hull of a surfboard, consisting of two board halves 1, 2 with or without an interposed central stringer, are made possible in that the two board halves 1, 2 are adhesively bonded together so tightly on the deck that the inner drop stitch threads almost touch one another (position 10F), while on the underwater hull adhesive bonding under less preloading (wide adhesive bonding) is selected (position 10G). The underwater hull takes on a convex shape in this case.

In contrast thereto, the shape becomes concave, if, at the bottom, the two surfboard halves 1, 2 are joined together by a "narrow" strip (position 10F) (increased preloading).

If the two surfboard halves 1, 2 on the deck side as well as on the underwater hull are adhesively bonded at the same distance from one another or, respectively, have been subjected to the same preloading (10F=10F), a straight, plane underwater hull is created.

Should one wish to design the concave or convex shape in an even more pronounced manner, this is attained by a change in the outlines of the left and right surfboard halves 1, 2, as shown in FIG. 5E. If it is hollowed out on the upper side in the bow region, that is to say, a caved-out region 10H is created and the sealing sidewall/sidewall lip 4 is adhesively bonded thereto, a more pronounced convex shape is brought about in the underwater hull.

In FIG. 6 a further embodiment according to the invention is described. In this case recesses 11, 11', 11" are formed in the inner sidewall lips 4 of the left and right board halves 1, 2, which allow the arrangement of internal components in the centre between the two surfboard halves 1, 2. The recesses 11, 11', 11" complement one another by corresponding recesses in the other surfboard half in order to accommodate functional parts.

This is shown by way of example in FIG. 7, in which, for example, a fin case for a fin 12 is introduced into a rear recess 11. The other recesses 11', 11" serve to accommodate a centreboard case 12C for a foldable centreboard 12A. The latter may be retracted into the centreboard case 12C by means of an actuating lever 12D—for example by touching it with the foot—from the extended position shown into the folded position 12B, so that, for example, on a downwind course hydrodynamic resistance is minimal.

A further embodiment is discussed in FIG. 8. In this embodiment, internal components 12, 13, 14, 15 may protrude through cut-outs 16 in the retaining strips 5. In this case, the retaining strips 5 or sleeve connections with the rows of sleeves 5B, 5D are provided with a cut-out 16, through which a fixation section of the internal component 12, 13, 14, 15 protrudes, so that further parts, such as a foot strap fitting or panels, representing a gliding surface, can be fitted thereto on the upper side and/or underside of the surfboard.

FIG. 8A shows a further type of stringer according to the invention, in which the two sides of the stringer 8A are provided with fine lines or projections 8B. If two such stringers 8A, 8A' are introduced side-by-side between the board halves 1, 2, they are forming a unit, wherein the, for example, zigzag-shaped projections/recesses mutually engage into one another in a form-fitting manner, so that shifting of the stringers 8A, 8A' in the longitudinal direction is virtually impossible. A foil or moulded body is laminated onto the inner sidewall of the two board halves 1, 2, provided with matching lines, so that the sides of the inserted stringers 8A, 8A' interlock with these foils. Regardless of how many stringers 8A, 8A' are inserted side-by-side between the board halves 1, 2, these remain clamped together in a stationary manner.

As shown in FIG. 8B, thin stringers 8C, 8C', 8C", 8C'" consisting of a foil laminate, may also be positioned side-by-side and in superimposed fashion. They are in this context positioned in the desired region by ropes, secured on both sides to the stringers 8C, 8C', 8C", 8C". In this case, a rope 8D may be assigned to the entire ensemble of stringers or to each individual stringer. These are positioned in the region between the inner sidewall lips 4 facing one another. In principle, it is also possible to move the stringers via these ropes 8D, depending on the application, or else to use different ensembles of stringers in order to allow an adaptation to the weight of the surfer. Excess rope ends preferably remain accessibly stowed at the tail ends of the surfboard between the surfboard halves.

A surfboard for paddling (SUP [stand up paddleboarding]) does not have to be of equal rigidity over the entire length. During paddling, the paddling person performs a dynamic up-down movement, which, based on the body weight, results in a significantly varying load application to the board. It is therefore important that especially in the central region, where the person is standing, high stability and rigidity exists. This can be dealt with in that the central region is stiffened by a plurality of overlapping stringers, while the two tail ends of the board (bow, stern) remain flexible.

Watercraft, in particular surfboards and kayaks or canoes, which are made of drop stitch material, are not usually manufactured with a pointed bow or a pointed stern, since, for manufacturing reasons, parts made of drop stitch material must always be round to ensure airtight adhesive bonding. In an embodiment according to the invention (FIG. 9), in the form of a surfboard, the flat stringer 20 according to FIG. 3, projecting from the board halves 1, 2 towards the front and rear, takes on the functions of a stem/stern post (Steven) so that the watercraft can be manufactured with a pointed bow and stern. The hydrodynamically optimised design of the bow and/or the stern is then brought about by a water- and airtight covering 19, which extends from the pointed ends of the flat stringer 20 to the surfboard and is all around adhesively bonded thereto.

The function of the stringer 26 is further elucidated in FIG. 10. In this embodiment according to the invention of the stringer 26, which projects at the front and rear beyond the floating body (formed by the board halves 1, 2) of the watercraft, the stringer 20, 26 is formed in the upward-pointing direction, taking on the function of a stem/stern post 27 (Steven).

In the embodiment according to FIG. 10, the watercraft, in the present case a canoe or kayak, is designed with a two-part floor 25 according to the invention, which is formed in the afore-described manner by the two bottom halves 1, 2, between which the upwardly bent stringer 26 is pressed. Side walls 24 are fitted to this floor 25, which, in turn, are likewise inflatable and together with the floor 25 form the hull of the kayak.

The floor 25, designed to have great longitudinal and transverse rigidity—as explained above—is reinforced by the upwardly bent stringer 26. The angled up end section of the stringer 26, in this case, forms a stem/stern post 27 (Steven). The hydrodynamic optimisation is again brought about by a watertight bow covering 28, which is adhesively bonded to the hull (sidewalls 24, floor 25), so that the hydrodynamically optimised structure shown at the bottom of FIG. 10 is brought about.

In most cases, except for very short surfboards or other watercraft, the stringer 8A, 20, 26, inserted in the mid-ship plane, must be split for transport reasons. The high contact pressure applied to the stringer or stringers through the two sides of the surfboard or the floor of a kayak or other watercraft, provides form-fitting connections of the individual stringer sections.

FIG. 11 shows an example of such a stringer connection, wherein two halves 20, 20' of the flat stringer 20 are interconnected in a positive or non-positive manner. In this case, rebates 22 are formed in a stringer half 20', into which engage support strips 21 of the other stringer half 20 (or a further stringer part). The cohesion of the two halves is ensured by the contact pressure and longitudinal rigidity is brought about by the two support strips 21 against the surfaces of which the rebate 22 abuts in a form-fitting (positive) manner. For further relative positioning of the two stringer halves 20, 20', a stopper, for example a magnet 23, may be provided which brings about a frictional connection.

If the channel between the two board halves or the bottom halves of another watercraft is to be sealed, this is possible by way of a watertight protuberance 30, adhesively bonded to the surfboard or watercraft, as shown in FIGS. 12-12D.

According to the representation in FIG. 12, the protuberance 30 is configured in a bag-like manner and is adhesively bonded to the covering of the two halves of the watercraft, in the present case the surfboard halves 1, 2, or connected thereto in another manner. For inserting a stiffening member 8, for example, a stringer, the protuberance 30 is brought into the inserting position shown at the top of the left-hand side of FIG. 12 and the insert component is introduced into the slot 7—the two board halves 1, 2 are in this case not inflated. After complete insertion of the insert component 8 into the not yet inflated board body (the end position of the insert component 8 is denoted by reference numeral 31 in FIG. 12), the resilient protuberance is flattened so that the inlet aperture is closed. The vertically folded section 32 is then rolled up, as shown at the bottom on the left-hand side of FIG. 12, and folded inwards through the slot 7, so that a watertight closure of the region receiving the insert component 8 is created. Subsequently, the floating body is then inflated so that the board halves 1, 2 are clamped to one another and the protuberance is also fixed under the pressure so that accidental detachment is not possible.

Inflatable surfboards are produced from PVC fabrics in different thicknesses. The thicker the PVC material, the more cumbersome it is in being processed. However, it is precisely the thicker PVC materials which are popular, because they are durable and robust. Joining two board halves 1, 2 of a surfboard or a kayak floor, which, as regards its shape, corresponds to a surfboard, is extremely difficult in a manual adhesive bonding process. No machines are available for doing so. The difficulty resides in getting the mostly somewhat twisted board halves straight in the adhesive bonding process. Embodiments of the inflatable watercraft according to the invention including a stiffening member have been produced successfully, using an adhesive bonding table 47, which is shown in FIG. 13 in a perspective view. The adhesive bonding table 47 is designed and made of individual, mobile components.

The adhesive bonding table 47 shown in FIGS. 13 and 13*a* to 13*c* is designed in the manner of a straightening bench and has a support 48 for the two board halves 1, 2, which are positioned on said support 48 in such a manner that they lie approximately side-by-side with their inner sidewall lips 4. This support is formed by a plurality of horizontal bars 36, which are guided in grooves 37 adapted to be displaced transversely. These adjustable support bars carry vertical bars 35, on which, in turn, horizontal, position-adjustable upper support bars are formed, which cover the board halves 1, 2 at least in sections, so that these are fixed on the side with respect to the vertical bars 35 and in the vertical direction (view according to FIG. 13) by the upper horizontal support bars 38 on the one hand, and by the support 48 (horizontal bars 36) on the other hand. The vertical bars 36 and consequently the vertical and horizontal bars 35, 38 adjustably fixed thereto are movably guided in the transverse direction of the surfboard/watercraft in the grooves 37 of the adhesive bonding table 47, so that the bars can be adjusted and then fixed to the respective outline of various surfboards.

For joining purposes, the two inflated board halves 1, 2 of the board (or parts of another watercraft) are placed onto the adhesive bonding table 47 and the vertical bars 35 are pushed along the grooves 37 from the outside to the sidewall lips 3 of the surfboard and then screwed tight by means of clamping screws 51 on a left and a right side of the adhesive bonding table 49, 50. The two sides of the adhesive bonding table 49, 50 are mounted to be adjustable in the transverse direction on a common table bed 52. The horizontal support bars 38 supported on the vertical bars 35 are adjusted to the height of the surfboard resting on the bars 36.

After this relative positioning of the support bars 35, 38 with respect to the outer contour of the surfboard/watercraft, the actual connection of the board halves 1, 2 may be performed. In this case, contact pressure may be applied via the vertical bars 35 and the horizontal support bars 38 by reducing the effective spacing of the sides of the adhesive bonding table 49, 50. This adjustment of the sides of the adhesive bonding table 49, 50 is brought about by way of a drive crank mechanism.

According to FIGS. 13A to 13C, the two sides of the adhesive bonding table 49, 50 are adjustable transversely to the longitudinal axis of the surfboard by means of the drive crank. The latter includes two threaded rods 39, 40 with threads running in the opposite direction, each of which are in operative engagement with the sides of the adhesive bonding table 49, 50 via a threaded sleeve 42. The drive of the threaded rod 39, 40 is brought about by a drive crank 41, so that, accordingly, by operating the drive crank 41, the effective spacing of the sides of the adhesive bonding table 49, 50 and therefore the spacing of the vertical bars 35 can be changed.

In this context, the bars 35 apply contact pressure to the outer sidewalls 44 (outer sidewall lips 3) during a movement from the outside towards the inside. In this manner, the surfboard is pressed together and its inner sidewalls 45 (inner sidewall lips 4) come to rest side-by-side in an approximately flat manner. The retaining strips 5, 5A, 5B and 5D can now be adhesively bonded. The adhesive bonding table allows further, prior to the adhesive bonding of the two board halves 1, 2, which are usually twisted, to straighten them by means of the horizontal bars 38.

During the adhesive bonding process, for example by fitting the retaining strips 5 or the support sleeves and/or by adhesively bonding of the inner sidewall lips 4 which are in planar abutment with one another, the surfboard halves 1, 2 are reliably held in the predefined relative position by the adhesive bonding table structure and maintain the appropriate contact pressure. After drying of the adhesive material the tensile load is transmitted by way of the fitted retaining strips 5, so that the relative position, in the inflated state, is maintained at least in the region of the inner sidewall lips 4 adjoining one another. After releasing the preloading by moving apart the sides of the adhesive bonding table 49, 50, the outer sidewalls 44 (outer sidewall lips 3) do, however, not retain their flattened shape, but bulge out elastically back into the rounded form of use. However, the inner sidewall lips 4 remain in planar abutment with one another, since the fitted retaining strips 5 continue to transmit the tensile load required for flattening.

The invention relates to an inflatable watercraft which consists of at least two inflatable parts that are joined together by means of retaining strips or the like under preloading. The invention also relates to a method for producing said inflatable watercraft and an adhesive bonding table that can be used in the production of the watercraft.

LIST OF REFERENCE NUMERALS

1 Left surfboard half
1A Right sidewall
1B Left sidewall
2 Right surfboard half
3 Outer sidewall lip
4 Inner sidewall lip
5 Retaining strips
5A Zipper
5B Left row of sleeves
5C Metal or plastic rod
5D Right row of sleeves
6 Inner sidewalls (4), lying side-by-side
7 Cavity
8 Stiffening member
8A Stringer
8B Lines and projections
8C Thin stringers
8D Ropes
9 Drop stitch threads
10 Stiffening member with cavity lips
10A Metal stringer
10B Groove on both sides
10C Additional groove
10D Tongue formation
10E Tongue formation retaining strips
10F Narrow adhesive bonding
10G Broad adhesive bonding
10H Hollowed-out portion
11 Recesses
12 Fin
12A Centreboard
12B Folded away position
12C Centreboard case
12D Actuating lever
13 Watertight case
14 Lower half of divisible integral component
15 Upper half and mast base receiving means of a divisible integral component
16 Cut-outs
17 Pointed bow
18 Pointed stern
19 Water- and airtight covering
20 Flat stringer
21 Support strips
22 Rebates
23 Magnet
24 Side walls
25 Floor
26 Upwardly bent stringer
27 Stem/stern post (Steven)
28 Watertight bow covering
29 Upper bow point
30 Watertight protuberance
31 Positioned in the surfboard
32 Vertically folded section
33 Rolled up position
34 Inserted position
35 Vertical rod
36 Horizontal rod
37 Groove
38 Upper horizontal support bars

39 Left-turning threaded rods
40 Right-turning threaded rods
41 Drive crank
42 Threaded sleeve
43 Spacing
44 Outer sidewalls
45 Inner sidewalls
47 Adhesive bonding table
48 Support
49 Left side of adhesive bonding table
50 Right side of adhesive bonding table
51 Tensioning screw
52 Table bed

The invention claimed is:

1. An inflatable watercraft the inflatable watercraft comprising:

an inflatable region of which is made, at least in sections, of drop-stitch material and including at least two parts that each form a closed air chamber so that each of the parts is inflated separately, wherein an upper side and an underwater side of the parts are joined together by retaining strips, respectively, so that a cavity is defined between each of the parts in which one or more stiffening members is inserted;

wherein the retaining strips being dimensioned in such a way that, in an inflated state, the parts are braced together with one another or the parts are braced together with the stiffening members placed in the cavity and/or with installation parts;

wherein an inner sidewall lip of each of the parts defines one or more recesses configured to accommodate internal components, into which the internal components are installed.

2. The inflatable watercraft according to claim 1, wherein the drop-stitch material includes drop-stitch threads arranged in an attachment area of the parts, the drop-stitch threads are close together in the inflated state and in a tensioned state.

3. The inflatable watercraft according to claim 1, wherein the retaining strips are glued onto the upper side and/or the underwater side in such a way that the parts, being an inflatable left half and an inflatable right half of the watercraft, are connected by the retaining strips in such a way that after the parts have been inflated, inner side walls of the parts experience a contact pressure that the parts form an approximately straight or level surface at a height of the watercraft, and wherein a sidewall lip of the parts are positioned on an outer circumference of the watercraft being rounded, in which case, the cavity at one or both ends of the watercraft each have an aperture on the upper side and/or the underside of the watercraft, through which the stiffening members is pushed in or inserted.

4. The inflatable watercraft according to claim 1, wherein the stiffening members is separable or are adapted to lie side-by-side in a layer configured to allow rolling up, over long sections, and joined in a form-fitting manner to bring about a reinforcement in a mid-ship plane of the watercraft.

5. The inflatable watercraft according to claim 1, wherein the internal components are installed prior to inflating the watercraft.

6. The inflatable watercraft according to claim 1, wherein the internal components is selected from the group consisting of fin cases, a watertight case, a mast base receiving means, and mounting members for add-on parts.

7. The inflatable watercraft according to claim 1, wherein the stiffening members are configured to be fittable to the internal components in a form-fitting manner or that the internal components are configured to enclose the stiffening members entirely or in part, so that a stiffening structural unit is created, bringing about longitudinal rigidity in a mid-ship plane of the watercraft.

8. The inflatable watercraft according to claim 1, wherein retaining strips are adhesively bonded to the upper side and/or the underside of the watercraft, in which cut-outs are located, one or a plurality of the cut-outs forming an aperture through which the stiffening members are inserted into the cavity.

9. The inflatable watercraft according to claim 1, wherein the internal components protrude in sections to form zones configured to be fittable with additional objects selected from the group consisting of foot straps, and reinforcing panels.

10. The inflatable watercraft according to claim 1, wherein one or a plurality of the recesses are of an elongate shape, configured to accommodate in each case only one of the internal component and that are connected to one of the stiffening members.

11. The inflatable watercraft according to claim 1, wherein one of the recesses is of an elongate shape, configured to receive a plurality of the internal components and that are connected to the one of the stiffening members.

12. The inflatable watercraft according to claim 1, wherein one of the recesses is of an elongate shape, receiving a plurality of the internal components and that are connected to one or more cavity lips of the stiffening members.

13. The inflatable watercraft according to claim 1, wherein the stiffening members project beyond the watercraft, forming a bow and a stern, and wherein a watertight and airtight covering is adhesively bonded to the parts of the watercraft.

14. The inflatable watercraft according to claim 1, further comprises one or more stringers made of metal, the stringers including a groove on both sides, the stringers are introduced in the cavity between the parts, and the retaining strips are adhesively bonded to the upper side and/or the underwater side of the parts with tongue formations of the stringers engaging in the grooves.

15. The inflatable watercraft according to claim 14, wherein the stringers are made from rigid rollable that are adhesively bonded to inner sidewalls of the parts.

16. The inflatable watercraft according to claim 1, wherein the retaining strips are configured to be separable in the form of a zipper.

17. The inflatable watercraft according to claim 1, wherein the retaining strips are configured to be separable in the form of a row of first sleeves adhesively bonded to one of the parts, and a row of second sleeves adhesively bonded to the other of the parts with a metal or plastic rod connecting both rows of sleeves.

18. The inflatable watercraft according to claim 1, wherein the retaining strips are of different widths.

19. The inflatable watercraft according to claim 1, further comprises a watertight and flexible protuberance configured to be rolled up, the watertight and flexible protuberance is configured to seal apertures defined at a front and a rear of the watercraft.

20. A method for the production of a watercraft according to claim 1, the method including the steps of:

a) manufacturing at least two parts of the watercraft out of a drop-stitch material, each of the parts forming an air chamber;

b) joining together the parts in the inflated state by tensioning with or without the stiffening member inserted into the cavity defined between the parts; and c) attaching, by adhesively bonding, the retaining strips to the parts in the tensioned state.

* * * * *